US007132913B2

(12) United States Patent
Whipple et al.

(10) Patent No.: US 7,132,913 B2
(45) Date of Patent: Nov. 7, 2006

(54) UNIVERSAL TERMINAL ASSEMBLY FOR ELECTRIC POWER SWITCH

(75) Inventors: Michael J. Whipple, Rochester, PA (US); Edward E. Lias, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 258 days.

(21) Appl. No.: 10/946,876

(22) Filed: Sep. 22, 2004

(65) Prior Publication Data

US 2006/0061441 A1 Mar. 23, 2006

(51) Int. Cl.
*H01H 13/04* (2006.01)

(52) U.S. Cl. ..... 335/202; 439/723; 439/724

(58) Field of Classification Search ..... 335/132, 335/202; 439/723–724
See application file for complete search history.

(56) References Cited

U.S. PATENT DOCUMENTS

| | | | | |
|---|---|---|---|---|
| 4,697,860 | A * | 10/1987 | Hildebrandt et al. | 439/374 |
| 5,488,337 | A * | 1/1996 | Hubbard et al. | 335/202 |
| 5,831,498 | A * | 11/1998 | Maloney et al. | 335/8 |
| 6,172,586 | B1 * | 1/2001 | Ferree et al. | 335/202 |
| 6,781,491 | B1 | 8/2004 | Whipple et al. | |
| 6,942,527 | B1 * | 9/2005 | Lias et al. | 439/814 |

* cited by examiner

*Primary Examiner*—Ramon M. Barrera
(74) *Attorney, Agent, or Firm*—Martin J. Moran

(57) ABSTRACT

A removable universal terminal assembly has a molded housing that clips onto an electric power switch and two terminal members that can be alternatively installed in the molded housing to provide either a quick connect termination or a binding post termination.

8 Claims, 4 Drawing Sheets

UNIVERSAL TERMINAL ASSEMBLY FOR ELECTRIC POWER SWITCH

BACKGROUND OF THE INVENTION

1. Field of the Invention

This invention relates to terminals for connecting electric power switches to electrical conductors, and particularly to terminals that can be used to make different types of connections to one or more conductors and which is usable with multiple configurations of electrical switches.

2. Background Information

Power switches used in electrical distribution systems, such as for instance, circuit breakers, transfer switches, disconnect switches, contactors, motor starters and the like, require connections for electrically connecting the power conductors of the switch to the electrical conductors of the distribution system. Typically, the power conductor of the switch is a rigid, flat conductor. A common connection for connecting cables to such switches is the collar terminal. The collar terminal has a cylindrical or square body with a transverse slot in which the flat power conductor of the switch and the wire or cable are received, and a tapped bore into which a screw is threaded to clamp the wire or cable against the power conductor while also securing the collar to the power conductor. Typically, the collar terminal is received in a recess in a molded casing of the power switch.

In some applications, it is desirable to have other types of connections for connecting the wires or cables to the power conductors of the switch. These other types of connections can include a quick connection and a binding post connection. In the past, quick connect terminals have been provided by replacing the collar terminal with a terminal fabricated from sheet material having a number of male connectors projecting from edges of one face, and a common tang projecting from an edge of the opposite face and braised or welded to the power conductor of the switch. Female clips on wires then slide onto the male connectors to provide multiple quick connections. The binding post connection can be provided by including a tapped hole in the terminal conductor of the switch and inserting a wire under the head of a binding post which is screwed down against the terminal conductor.

While these alternative connections allow a user choice in making connections to a power switch, they require the user to purchase and the manufacturer to inventory different switches with the dedicated type of connection for different applications.

Commonly owned U.S. Pat. No. 6,781,491, entitled "Quick Connect Terminal For Electric Power Switch", discloses a quick connect terminal having a molded housing that can be removably mounted to the molded casing of the power switch at the terminal recess in the switch casing. An electrically conductive terminal member has a tang at one end which is clamped to the main conductor of the switch by a collar terminal. The terminal member is a flat strip having a tang at one end and a center section perpendicular to the tang which extends along the housing of the quick connect terminal and has a number of spade terminations extending through slots in the housing wall to an open cavity where connections can be made to female terminal members on a number of wires. While this terminal assembly provides an easy choice between a collar terminal and spade type quick connect terminations, it does not also provide an easy and quick binding post termination.

SUMMARY OF THE INVENTION

This invention is directed to a universal terminal assembly that provides flexibility in terminal connections for an electric power switch. The universal terminal assembly removably attaches to the molded casing of the power switch and has the capability of providing either a quick connect termination or a binding head termination. The removable housing of the universal terminal assembly is constructed to receive the first terminal member which provides spade terminations for the quick connect termination or a second terminal member that provides the binding post termination.

More particularly, the universal terminal assembly for an electric power switch having a molded casing with a main conductor extending into an external terminal recess in the molded casing comprises: a selectable first terminal member having a first tang on a first end and at least one spade termination on a second end; and a selectable second terminal member comprising a flat conductive member having a second tang at a first end and a tapped hole adjacent a second end, and a binding post threaded into the tapped hole. The universal terminal assembly further includes a molded housing having a mounting removably mounting the molded housing to the molded casing of the power switch and an open cavity formed in part by a partition wall separating the open cavity from the terminal recess. The partition wall has through openings through which a selected one of the first terminal member and the second terminal member extends with the first end in the terminal recess and the respective one of the first tang and the second tang engaging the main conductor, and with the second end in the open cavity. The partition wall further has a first retainer retaining the first terminal member in the housing when the first terminal member is the selected one of the first terminal member and the second terminal member, and a second retainer retaining the second terminal member in the housing when the second terminal member is the selected one.

In accordance with one aspect of the invention, the partition wall of the housing has first slots through which a plurality of the spade terminations extend when the first terminal member is selected and a second slot for the second terminal member. In one embodiment of the invention, the first slots comprise spaced parallel slots and the second slot extends transversely between the spaced parallel slots to form the second retainer as a tongue extending toward the second terminal member when selected.

In accordance with another aspect of the invention, the housing of the universal terminal assembly has a base wall extending outward from the partition wall adjacent the second slot and the second terminal member has an intermediate section offsetting in parallel planes the first end and the second end. The second end of the second terminal member is wider than the first end forming lateral shoulders spaced from the intermediate section. The tongue is dimensioned to capture the second terminal member in the housing when the second end of the second terminal member is seated on the base wall with the lateral shoulders facing the partition wall on either side of the second slot.

As another aspect of the universal terminal assembly, the molded housing of the universal terminal assembly has an extension which receives the binding post when threaded through the second terminal member to provide electrical isolation for the binding post.

Yet another aspect of the invention is a removable wall in the housing opposite the base wall that is removable for access to the binding post. The housing can be molded with a thin frangible web securing this removable wall to the remainder of the housing so that it may be easily removed when the second, binding post terminal member is selected.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
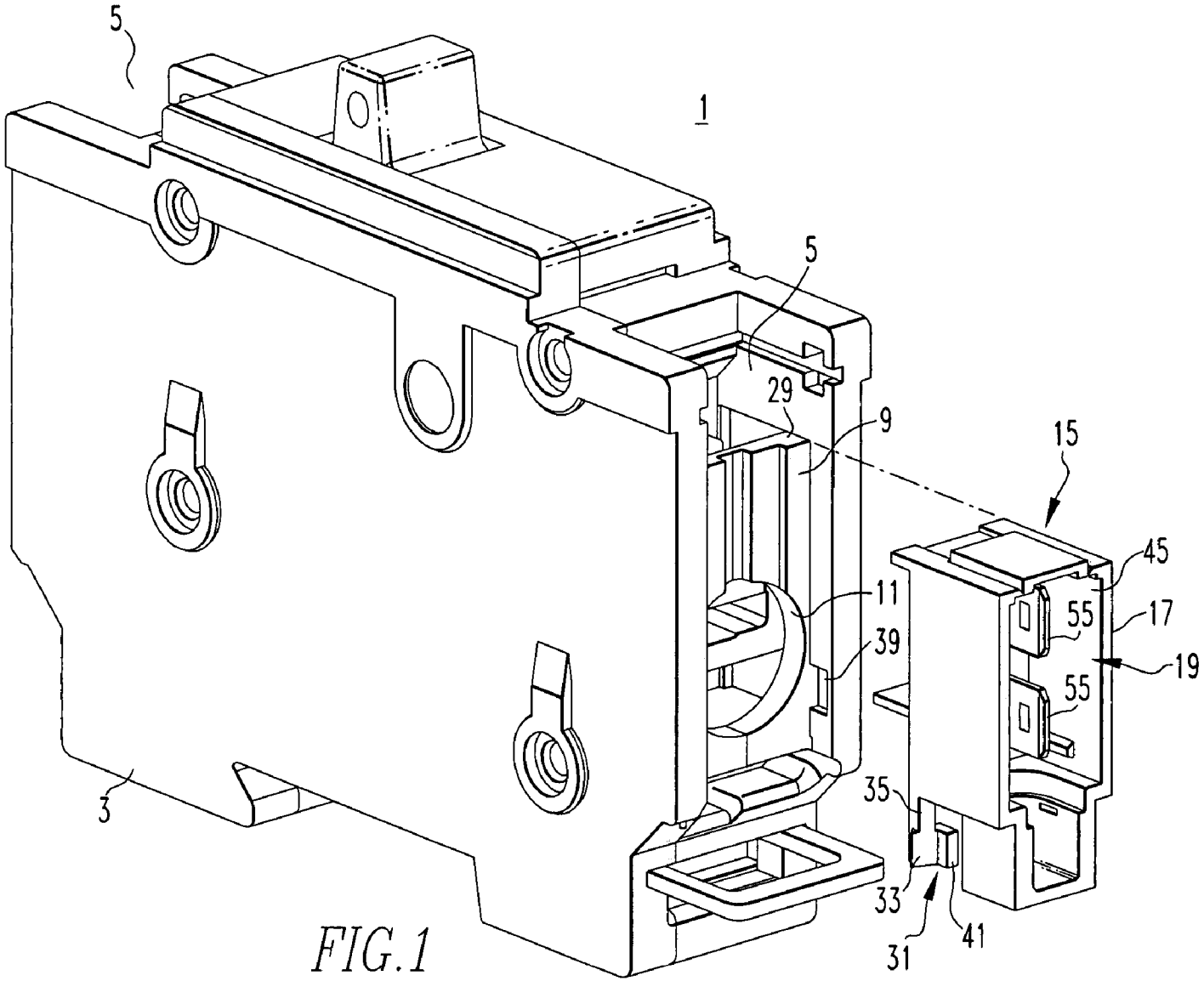
FIG. 1 is an exploded isometric view of a circuit breaker with a universal terminal assembly in accordance with one embodiment of the invention aligned for mounting on the circuit breaker.
Figure 6:
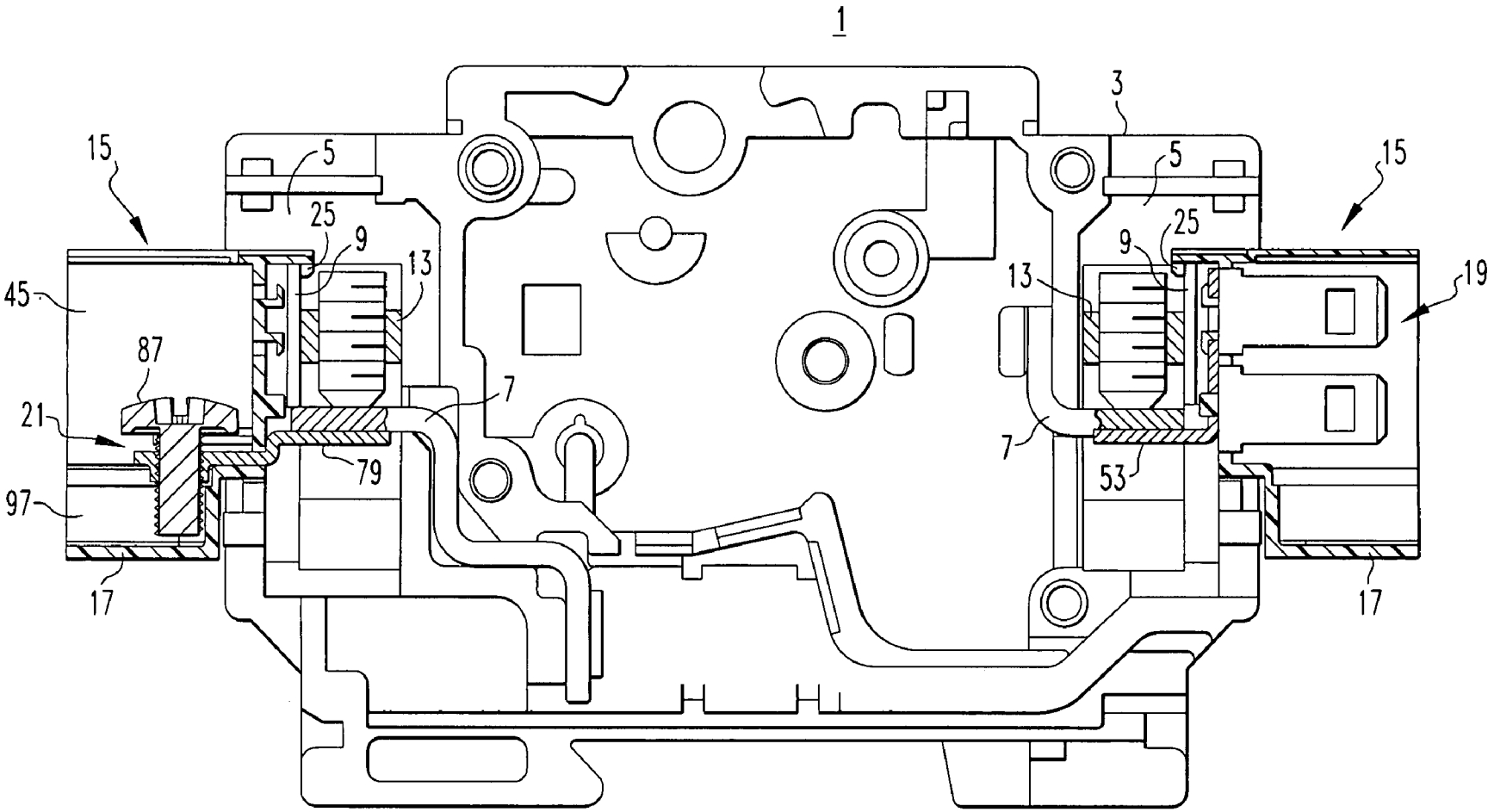
FIG. 6 is a front view of the base of the molded casing of the circuit breaker of FIG. 1 showing in section two embodiments of the universal terminal assembly installed.

The universal terminal assembly of the invention will be described as applied to a miniature circuit breaker. However, it will be evident that this universal terminal assembly can be used with other electric power switches. Referring to FIG. 1, the circuit breaker 1 has a molded casing 3 which forms at each end an external terminal recess 5. The main conductors 7 of the circuit breaker extend into and terminate in these external terminal recesses 5 (see FIG. 6). The external terminal recess 5 has a front wall 9 with an opening 11 through which a cable (not shown) can be inserted for connection to the main conductor 7 such as by a collar terminal 13, as is well known.

Figure 2:
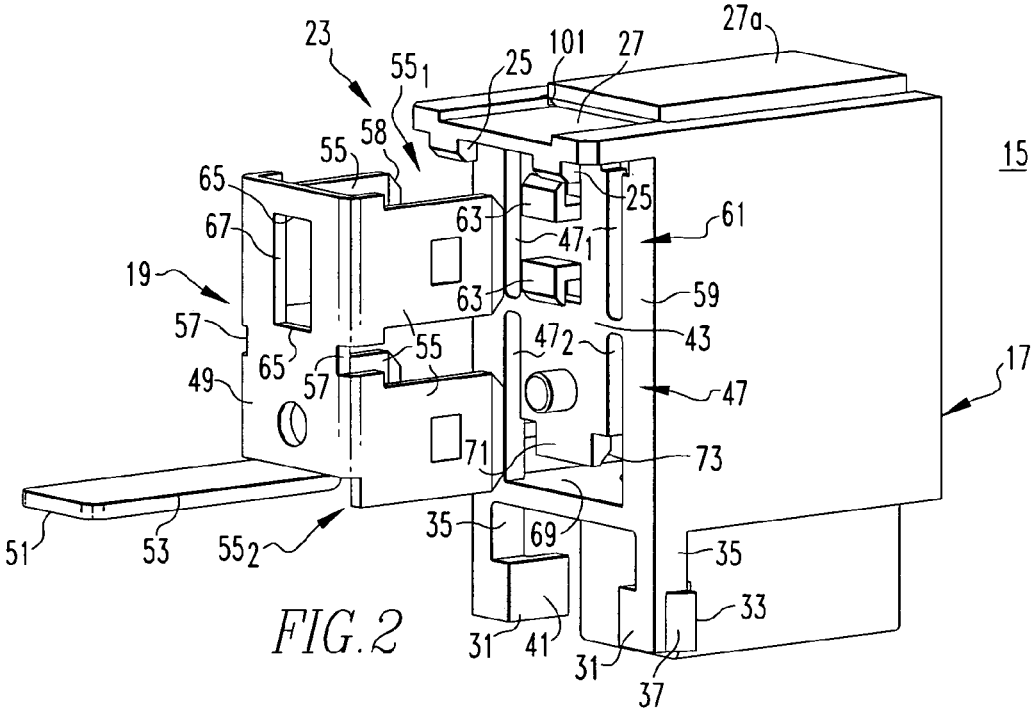
FIG. 2 is an exploded isometric view of the universal terminal assembly shown in FIG. 1.

The invention makes it possible to adapt the circuit breaker 1 for other types of terminal connections. The universal terminal assembly 15 offers the capability of providing two other types of terminal connections: a quick connect termination and a binding post termination. The universal terminal assembly 15 has a molded housing 17 that receives either a first terminal member 19 shown in FIGS. 1 and 2 that provides the quick connect terminations, or a second terminal member 21 shown in FIGS. 3 through 5 that provides the binding post termination.

The molded housing 17 of the universal terminal assembly 15 is secured to the circuit breaker 1 by a mount 23. The mount 23 includes mounting lips 25 projecting downward from an extension of the top wall 27 of the molded housing 17 that hook over the top edge 29 of the front wall 9 of the molded casing 3 of the circuit breaker 1. The mount 23 further includes a pair of spaced apart compliant latches 31 having outward oppositely facing latch hooks 33 cantilevered from the bottom of the housing 17 on latch legs 35. The latch hooks 33 have chamfered front edges 37 which cam the latches inward until the hooks 33 snap into recesses 39 in the molded casing 3 of the circuit breaker 1. A pair a integrally molded finger grips 41 can be squeezed together to release the latches for removal of the housing from the circuit breaker.

The molded housing 17 has a partition wall 43 that separates an open cavity 45 from the terminal recess 5 in the circuit breaker casing 3. A plurality of first slots 47 form through openings in the partition wall 43. In the exemplary housing 17 there are two sets $\mathbf{47}_1$ and $\mathbf{47}_2$ of parallel spaced apart first slots 47.

The first terminal member 19 is formed of a flat strip of electrically conductive material having a center section 49 and a first end 51 bent to form a first tang 53 extending transversely from one end of the center section in a first direction. A plurality of spade terminations 55 extend like fingers from side edges 57 of the center section 49 to form a second 58 end of the first terminal member 19. The exemplary first terminal member 19 has four such spade terminations 55 which can be considered as two pair, $\mathbf{55}_1$ and $\mathbf{55}_2$, each including one spade termination 55 in each side edge 57 of the center section 49 and in spaced parallel relation.

When quick connect terminations are desired, the universal terminal assembly 15 is assembled with the center 49 of the first terminal member 19 extending along the rear face 59 of the partition wall 43 with the spade terminations 55 extending through the first slots 47 and terminating in the open cavity 45. More particularly, the spade pair $\mathbf{55}_1$ and $\mathbf{55}_2$ extend through the sets of slot $\mathbf{47}_1$ and $\mathbf{47}_2$, respectively. A first retainer 61 secures the first terminal member 19 to the molded housing 17. This first retainer 61 is formed by a pair of oppositely facing catches 63 molded on the rear face 59 of the partition wall 43 that engage opposite edges 65 of the rectangular opening 67 in the center section 49 of the first terminal member 19 to fix the relative position of the first terminal member 19 on the molded housing 17.

The universal terminal assembly 15 is then secured to the circuit breaker 1 by hooking the mounting lips 25 on the molded housing 17 over the top edge 29 of the front wall 9 on the molded casing 3. The molded housing 17 is then rotated downward so that the first tang 53 of the first terminal member 19 passes through the opening 11 in the front wall 9 of the casing 3 and slides into the collar terminal 13 (see FIG. 6). As the molded housing 17 is further rotated until it is flat against the end of the molded casing 3 of the circuit breaker, the latches 31 are deflected inward by the side edges of the recess 5 until they snap into the latch recesses 39 to securely attach the housing 17 to the circuit breaker 1. The collar terminal 13 is then tightened to clamp the first tang 53 against the main conductor 7 thereby electrically connecting the spade terminations 55 to the main conductor of the circuit breaker. Whenever it is desired to remove the quick connect terminal, the collar terminal 13 is unscrewed to release the first tang 53. Then, the finger grips 41 are squeezed together to release the latches 31 from the latch recesses 39 so that the housing 17 can be rotated upward to extract the tang 53 from the opening 11 and unhook the mounting lips 25 from the top of the front wall 9 of the circuit breaker molded casing.

The molded housing 17 of the universal terminal assembly 15 has a second slot 69 that forms a through opening in the partition wall 43 and extends transversely between the lower ends of the lower pair $\mathbf{47}_2$ of the spaced parallel first slots 47. The slots $\mathbf{47}_2$ and 69 form a tongue 71 which is chamfered at 73.

Figure 3:
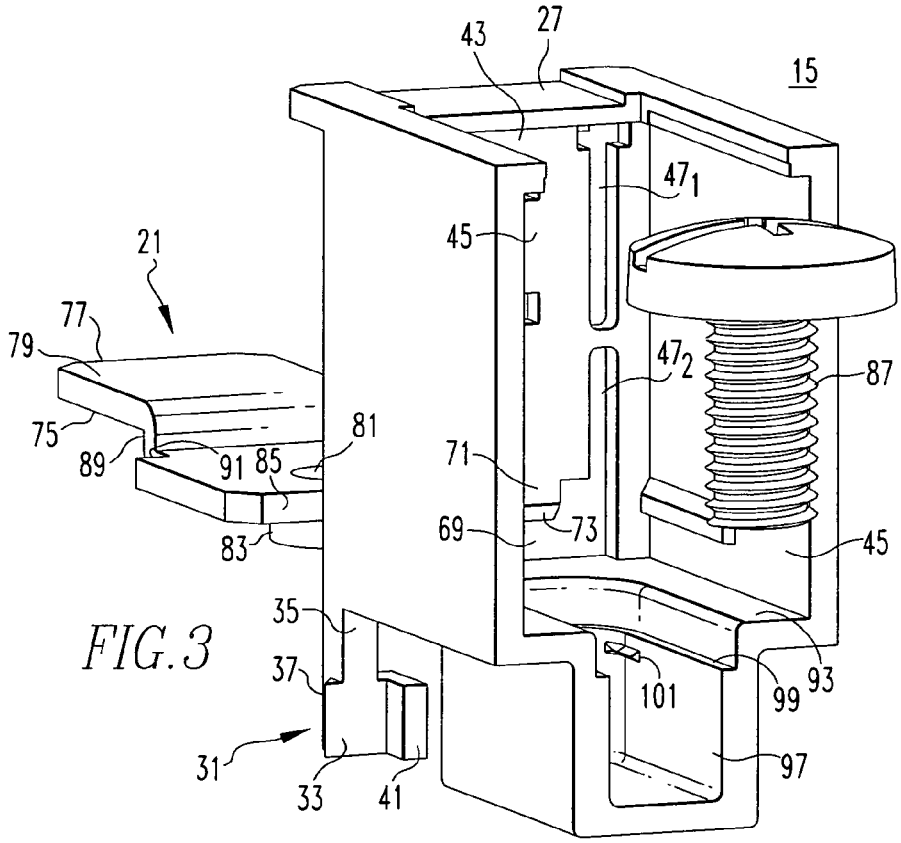
FIG. 3 is an exploded isometric view of a universal terminal assembly in accordance with another embodiment of the invention.
Figure 5:
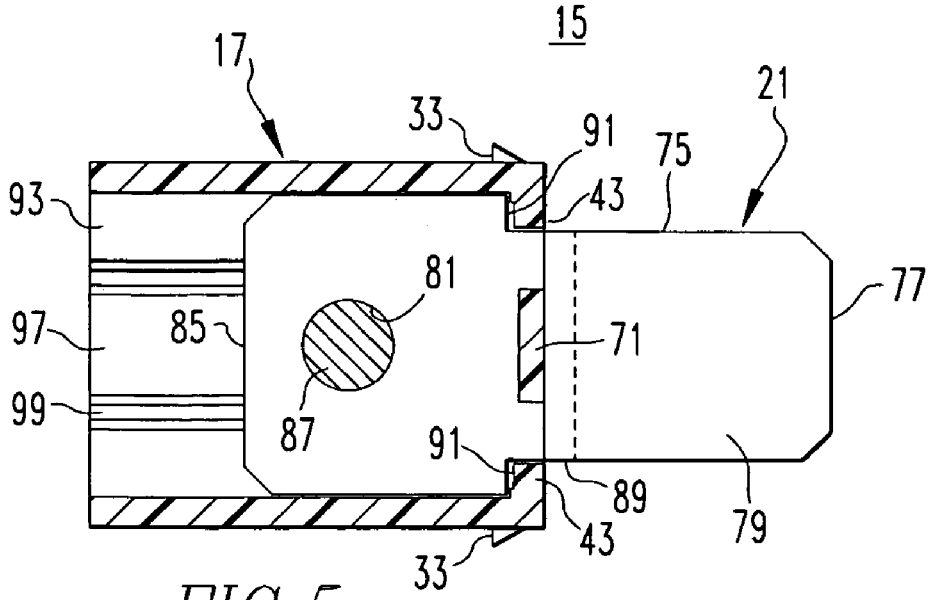
FIG. 5 is a section view taken along the line 5—5 through FIG. 4.
Figure 4:
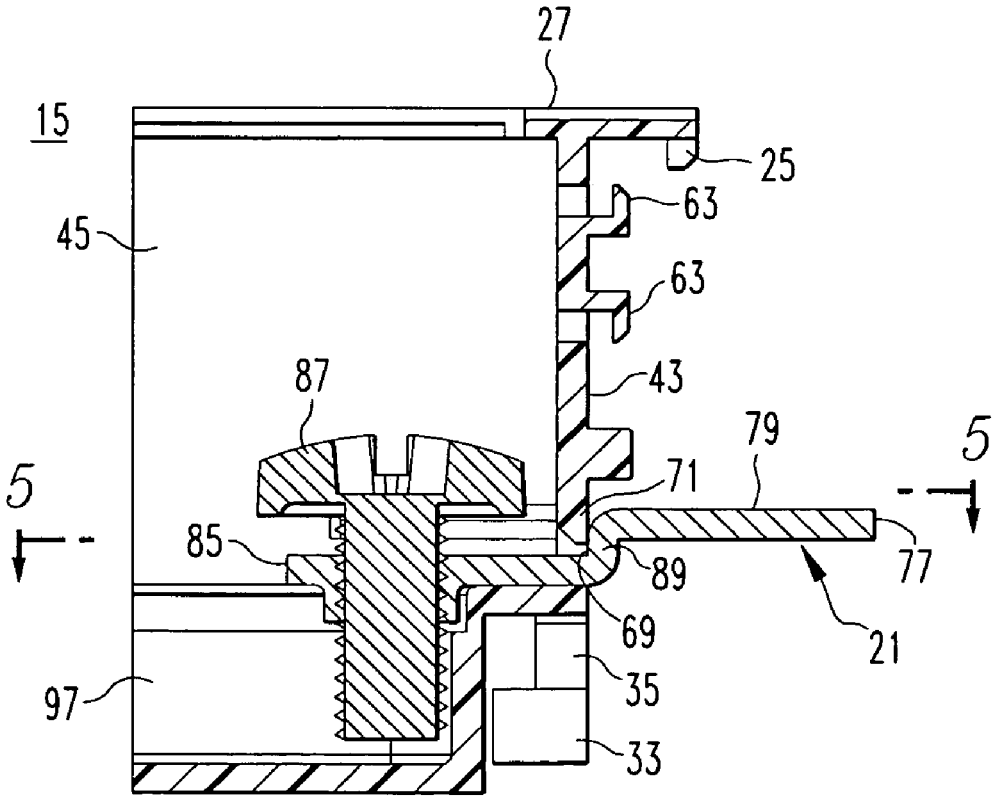
FIG. 4 is a longitudinal section through an assembled universal terminal assembly of the embodiment shown in FIG. 3.

When a binding post termination is desired, the second terminal member 21 is used. Referring to FIGS. 3 through 5, the second terminal member 21 comprises an elongated electrically conductive member 75 forming at a first end 77 a second tang 79. A tapped hole 81 through a boss 83 adjacent the second end 85 of the elongated member 75 receives a binding post 87. A reverse bend formed in an intermediate section 89 of the elongated member offsets the first end 77 and the second end 85 in parallel planes. The second end 85 of the elongated member 75 is wider adjacent the intermediate section 89 for form a pair of lateral shoulders 91. As can be seen best in FIG. 3, the housing 17 has a base wall 93 that extends the open cavity 45 through a groove 97. The groove 97 is stepped at 99 and includes partial threads 101.

When a binding post termination is desired, the universal terminal assembly 15 is assembled by inserting the first end 77 of the elongated member 75 into the open cavity 45 and through the second slot 69. The tongue 71 forms a second retainer that is deflected as the second tang 79 is inserted through the second slot 69 then captures the elongated member 75 as the lateral shoulders 91 seat against the partition wall 43 and the intermediate section 89 passes beyond the tongue 71. While this retains the second terminal member 21 in the housing, the partial threads 101 engage the binding post 87 to restrain the second terminal member 21 from rotating under the tongue 71, which assists in fixing the position of the second tang 79 for mounting the universal terminal assembly 15 on the circuit breaker 1. This embodiment of the universal terminal assembly 15 is removably mounted on the circuit breaker 1 in a manner similar to that described above in connection with the embodiment providing the quick connect terminations. Again, the tang 79 is electrically and mechanically secured to the main conductor 7 in the circuit breaker using a collar terminal 13 (see FIG. 6). The top wall 27 of the housing 17 has a removable section 27*a* secured in place by molded frangible webs 101 that may be fractured to remove the section 27*a* to provide access for a screwdriver (now shown) to thread the binding post 87 into the tapped hole 81.

As can be appreciated, the universal terminal assembly 15 provides the user of the circuit breaker 1 with a great deal of flexibility with regard to terminations. The circuit breaker 1 remains unchanged and can be used with the standard collar terminal if desired. Alternatively, the circuit breaker can be quickly and temporarily modified to provide a quick connection or a binding post connection through use of the universal terminal assembly 15 and selection of the either the first terminal member 19 or the second terminal member 21, respectively. Also, the manufacturer of the circuit breaker only has to inventory and supply a standard circuit breaker with alternate terminations provided by the universal terminal assembly 15 and one or both of the first and second terminal members.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A universal terminal assembly for an electric power switch having a molded casing with a main conductor extending into an external terminal recess in the molded casing, the terminal assembly comprising:

a selectable first terminal member having a first tang on a first end and at least one spade termination on a second end;

a selectable second terminal member comprising an elongated electrically conductive member having a second tang at a first end and at tapped hole adjacent a second end, and a binding post threaded into the tapped hole; and a molded housing having a mount removably mounting the molded housing to the molded casing and an open cavity formed in part by a partition wall separating the open cavity from the terminal recess, the partition wall having through openings through which a selected one of the first terminal member and the second terminal member extends with the corresponding first end in the terminal recess with the respective one of the first tang and the second tang engaging the main conductor, and with the second end in the open cavity, the partition wall further having a first retainer retaining the first terminal member in the housing when the first terminal member is the selected one of the first terminal member and the second terminal member and a second retainer retaining the second terminal member in the housing when the second terminal member is the selected one.

2. The universal terminal assembly of claim 1 wherein the first terminal member has a plurality of spade terminations at the second end and the through openings in the partition wall of the housing comprise first slots through which the plurality of spade terminations extend when the first terminal member is the selected one, and a second slot through which the second terminal member extends when the second terminal member is the selected one.

3. The universal terminal assembly of claim 2 wherein the first slots comprise at least a pair of spaced parallel slots in the partition wall and the second slot extends transversely between the at least one pair of spaced parallel slots to form the second retainer as a tongue extending toward the second terminal member when the second terminal member is the selected one.

4. The universal terminal assembly of claim 3 wherein the housing has a base wall within the open cavity extending outward from the partition wall adjacent the second slot, the second terminal member has an intermediate section offsetting in parallel planes the first end and the second end with the second end being wider than the first end to form lateral shoulders spaced from the intermediate section, and the tongue is dimensioned to capture the second terminal member in the housing when the second end of the second terminal member is seated on the base wall with the lateral shoulders facing the partition wall on either side of the second slot.

5. The universal terminal assembly of claim 4 wherein the base wall of the housing has a groove aligned with the tapped hole, the groove having at least partial threads engaging the binding post.

6. The universal terminal assembly of claim 5 wherein the second terminal member has a boss extending toward the groove and through which the tapped hole extends, the groove being stepped to receive the boss.

7. The universal terminal assembly of claim 4 wherein the housing has a removable wall section opposite the base wall removable to provide access to the binding post when the second terminal member is the selected one.

8. The universal terminal assembly of claim 7 wherein the housing is molded with a thin frangible web securing the removable wall section in place opposite the base wall.

* * * * *